US005090635A

United States Patent [19]

Grecksch

[11] Patent Number: 5,090,635

[45] Date of Patent: Feb. 25, 1992

[54] MACHINE FOR PRODUCING CROSS-WOUND BOBBINS OR CHEESES

[75] Inventor: Hans Grecksch, Mönchengladbach, Fed. Rep. of Germany

[73] Assignee: W. Schlafhorst AG & Co., Mönchengladbach, Fed. Rep. of Germany

[21] Appl. No.: 660,436

[22] Filed: Feb. 22, 1991

[30] Foreign Application Priority Data

Feb. 22, 1990 [DE] Fed. Rep. of Germany ..... 4005547

[51] Int. Cl.[5] ..... B65H 54/20; B65H 54/22

[52] U.S. Cl. ..... 242/35.6 R; 242/35.5 R

[58] Field of Search ..... 242/35.6 R, 35.6 E, 242/35.5 R, 18 R

[56] References Cited

U.S. PATENT DOCUMENTS

| | | | |
|---|---|---|---|
| 2,208,930 | 7/1940 | Kahlisch | 242/35.6 R |
| 3,281,088 | 10/1966 | Matsui et al. | 242/35.6 R |
| 3,776,479 | 12/1973 | Lutovsky et al. | 242/35.6 R |

FOREIGN PATENT DOCUMENTS

| | | |
|---|---|---|
| 1560610 | 10/1969 | Fed. Rep. of Germany . |
| 1560367 | 3/1971 | Fed. Rep. of Germany . |
| 1551115 | 12/1968 | France . |

*Primary Examiner*—Stanley N. Gilreath
*Attorney, Agent, or Firm*—Herbert L. Lerner; Laurence A. Greenberg

[57] ABSTRACT

A machine for producing cross-wound bobbins or cheeses includes winding apparatuses each having a yarn delivery device, yarn guide devices disposed downstream of the yarn delivery device as seen in a yarn travel direction, and a yarn take-up device disposed downstream of the yarn guide devices. The yarn take-up device has a bobbin frame for carrying a cheese with a center of gravity. The bobbin frame is pivotable about a pivot shaft. A winding roller for engaging the cheese and rotating about an axis of rotation for guiding the yarn around the winding roller from a given path of the yarn traveling toward the cheese. At least one yarn breakage correcting device. A suction nozzle with an inlet mouth for retrieving a broken yarn having run up onto the cheese and an oblong slit for guiding the broken yarn to the breakage correcting device. The center of gravity of the cheese and the axis of rotation of the winding roller define an imaginary plane. The pivot shaft of the bobbin frame, the given path of the yarn at the winding roller, and the inlet mouth are all disposed on one side of the plane. Another side of the plane faces a free servicing and/or equipping and/or inspection space extending along the cheese winding machine.

11 Claims, 2 Drawing Sheets

MACHINE FOR PRODUCING CROSS-WOUND BOBBINS OR CHEESES

Figure 1:
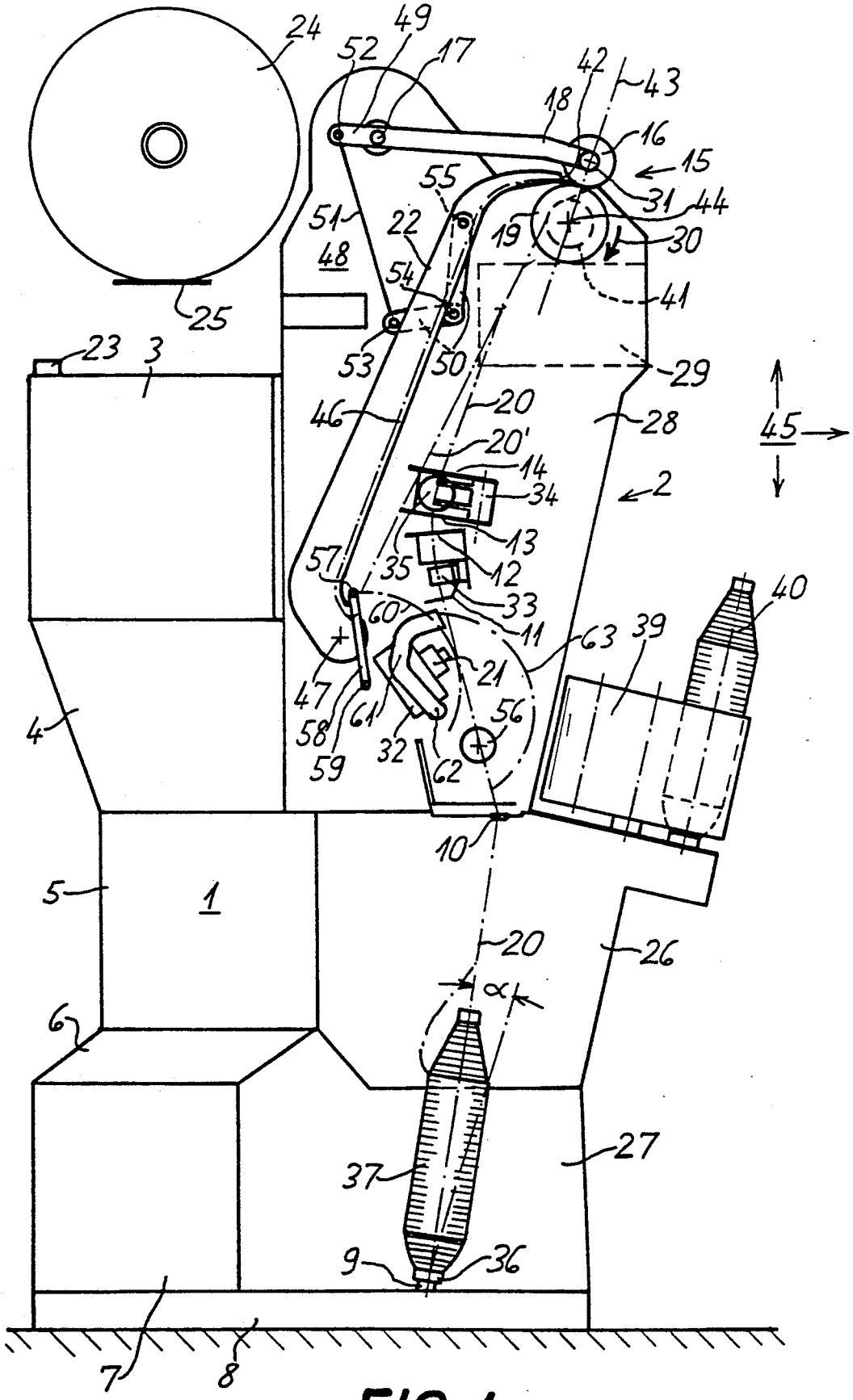

The invention relates to a machine for producing cross-wound bobbins or cheeses, including winding apparatuses each having a delivery device, yarn guide devices, and a take-up device with a bobbin frame carrying a cheese and being pivotable about a pivot shaft, a winding roller engaging the cheese and around which the traveling yarn is passed to the cheese and at least one yarn breakage correcting device and a suction nozzle retrieving a broken yarn having run up onto the cheese.

Such a device is known from German Published, Non-Prosecuted application DE-OS 1 560 610.

Automatic bobbin winders, bobbin winding machines or spinning machines are possible examples of such cross-wound bobbin or cheese producing machines, as long as the yarn is wound to make cross-wound bobbins or cheeses at spinning or work stations thereof. Depending on the type of cheese-producing machines, the yarn delivery device is constructed as a cop or bobbin payout device, a spinning device, a bobbin creel, or the like.

Examples of known yarn guide devices are yarn eyelets, balloon checking or restriction devices, yarn guides on yarn cleaners, yarn brakes, paraffin-applying devices, or the like.

The take-up devices are equipped with special yarn guide devices in order to produce the cross-wound layers of the cheese. Either the traveling yarn is caused to traverse by means of a reciprocating yarn guide, or the traversing is performed by a winding roller provided with reversing thread grooves. The winding roller can serve to drive the cheese, and accordingly it can also serve to lay the yarn in cross-wound layers on the cheese.

Automatic slicers or knotting devices are known as yarn breakage correcting devices. The yarn end that has run up onto the cheese after yarn breakage is retrieved by the suction nozzle and can thereupon be advanced again, either through the suction nozzle itself or through special devices of the yarn breakage correcting device.

One yarn breakage correcting device can be provided on each winding apparatus. This is usually the case particularly with high-speed automatic bobbin winders. However, the yarn breakage correcting device may also be responsible for more than one winding apparatus at a time. In that case, it is constructed in such a way that is can move, and if a yarn breakage occurs it is automatically moved to the winding apparatus having the problem.

If the cheese winding machine is a spinning machine, such as an open end spinning machine, then the yarn breakage correcting device can be constructed as a re-piecing device. In re-piecing, neither a splice nor a knot is formed. Instead, the yarn end is retrieved from the cheese and introduced into the spinning device, where it joins with the fiber material supplied afterward. The result is a so-called piecer, in other words a connection that either has the same kind of yarn cross section, or one that deviates slightly from the yarn cross section in either direction. The connection as a rule is small enough so that it cannot even be classified or recognized as a flaw.

The outcome of winding or spinning, that is the efficiency of known cheese winding machines, still needs some improvement. There are many possible ways in which yarn travel or winding operation may undesirably be impaired by the persons using the spaces intended for servicing and/or equipping and/or inspection, and conversely such persons are sometimes hindered in their freedom of action by the machine during operation.

It is accordingly an object of the invention to provide a machine for producing cross-wound bobbins or cheeses, which overcomes the hereinafore-mentioned disadvantages of the heretofore-known devices of this general type, and which provides for a good outcome of winding, while avoiding the danger of interference with or impairment of the machine or winding operation by persons using the free space or service walkway.

With the foregoing and other objects in view there is provided, in accordance with the invention, a machine for producing cross-wound bobbins or cheeses, comprising winding apparatuses each having a yarn delivery device, yarn guide devices disposed downstream of the yarn delivery device as seen in a yarn travel direction, a yarn take-up device disposed downstream of the yarn guide devices, the yarn take-up device having a bobbin frame for carrying a cheese with a center of gravity, the bobbin frame being pivotable about a pivot shaft, a winding roller for engaging the cheese and rotating about an axis of rotation for guiding the yarn around the winding roller from a given path of the yarn traveling toward the cheese, and at least one yarn breakage correcting device, and a suction nozzle with an inlet mouth for retrieving a broken yarn having run up onto the cheese, the center of gravity of the cheese and the axis of rotation of the winding roller defining an imaginary plane with one side on which the pivot shaft of the bobbin frame, the given path of the yarn at the winding roller, and the inlet mouth are all disposed and another side facing or being oriented toward a free space for servicing and/or equipping and/or inspection purposes extending along the cheese winding machine.

With this apparatus having a protected yarn travel in the direction facing away from the free space, a good cheese structure is attained particularly because the yarn travel around the winding roller to the cheese is on the side of the afore-mentioned plane on which the pivot shaft of the cheese is also located. In other words, the traveling yarn passes through a plane in which the axis of rotation of the winding roller and at least one point of the pivot shaft of the bobbin frame are located.

At the same time, independently of the option for automatic bobbin exchange, manual access to the bobbin from the service walkway is not hindered, because the pivot shaft of the bobbin frame is oriented away from the person using the service walkway. The yarn travel is protected, because the yarn travels to the cheese behind the winding roller, as seen from the service walkway. As a result, additional yarn guide devices can also be better disposed than before in such a way that the yarn travels in a protected region that is shielded from the service walkway. On the other hand, the freedom of action of the person using the service walkway is not as severely restricted by the machine during operation. Danger to such persons, which was previously threatened by pivoting parts such as bobbin frames or suction nozzles, especially if there was a sudden disruption in winding operation, is then avoided.

For the sake of rapid correction of a yarn break and thus for the sake of improving the efficiency of the machine, in accordance with another feature of the invention, the suction nozzle is movably disposed and has a control device that keeps its inlet mouth at a predetermined distance from the growing cheese.

In accordance with a further feature of the invention, the control device advantageously is a control mechanism that carries over or steps up the motion of the bobbin frame and transmits it to the suction nozzle.

In accordance with an added feature of the invention, the control mechanism is a multiple-link transmission connecting the bobbin frame to the suction nozzle.

Accordingly, it is possible to use very simple devices, with the aid of which the suction nozzle can be kept at a predetermined distance from the surface of the cheese in any winding state of the cheese. Otherwise, an average distance of the mouth from the cheese surface would have to be ascertained and would have to be adhered to if the suction nozzle mouth were fixed to the frame. However, that would mean that as the bobbin becomes fuller and fuller, the distance between the inlet mouth and the surface of the bobbin would as a rule become smaller and smaller, so that if the cheese is moving, more and more fibers would come into contact with the inlet mouth, or the inlet mouth might even start to scrape against the cheese, especially since surface eccentricity or unevenness can occur as the size of the cheese grows. The invention is accordingly intended to avoid such resultant difficulties as well.

In accordance with a concomitant feature of the invention, the suction nozzle is a suction tube being curved toward the yarn travel or path having an inlet mouth that is widened up to the bobbin width and an oblong slit serving to guide the aspirated yarn which ends freely at the inlet mouth, is disposed on the concave side of the suction tube and is oriented toward the yarn guide devices and/or toward the yarn breakage correcting device.

The oblong slit has the known advantage of ensuring that whenever the yarn has been aspirated far enough into the suction tube, it emerges from the oblong slit, and as a result either enters the yarn guide devices of the winding apparatus or travels into the yarn breakage correcting device on its own, or else it can be grasped by simple means, such as levers or grippers, and advanced to the yarn breakage correcting device, for instance.

Except for slight motions that serve the purpose of enabling the inlet mouth to deflect away from the increasingly large cheese in a controlled manner, a suction nozzle constructed and disposed according to the invention does not need to execute any further motions.

Other features which are considered as characteristic for the invention are set forth in the appended claims.

Although the invention is illustrated and described herein as embodied in a machine for producing cross-wound bobbins or cheeses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
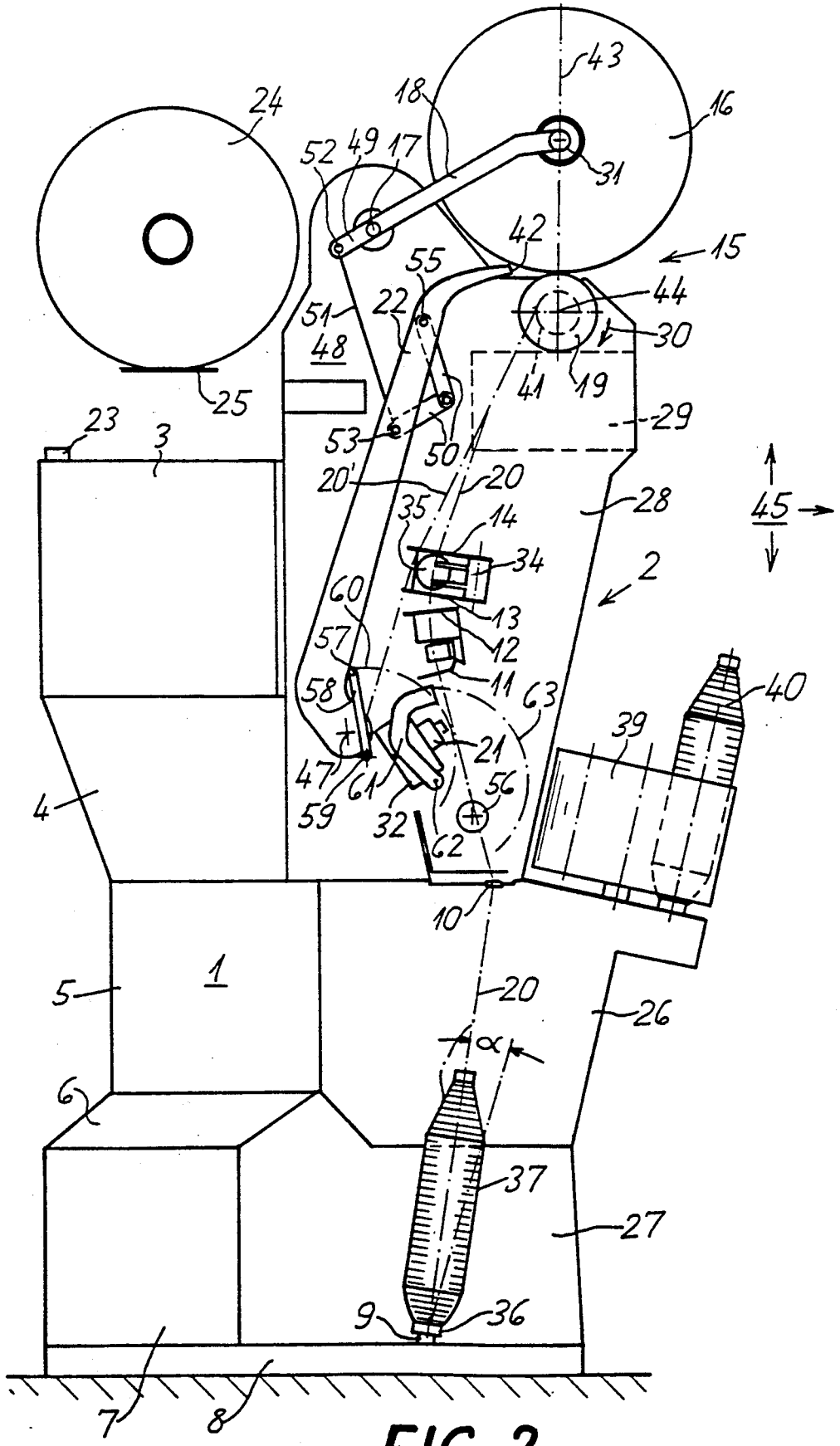

FIGS. 1 and 2 are diagrammatic, elevational views of the same exemplary embodiment of the invention, but with the winding of a cheese at different stages.

Referring now to the figures of the drawing in detail and first, particularly, to FIG. 1 thereof, there is seen a cross-wound bobbin or cheese winding machine, shown generally at reference numeral 1, which has a plurality of identical winding apparatuses 2. The winding apparatuses are disposed in a line on the front of a multiple-part machine frame 3–8. Each of the winding apparatuses 2 has one yarn delivery device 9, yarn guide devices 10–14, and one take-up device, which is identified overall at reference numeral 15.

The take-up device 15 has a conventional bobbin frame 18 that carries a cheese 16 and is pivotable about a pivot shaft 17, as well as a winding roller 19 which engages the cheese 16 and around which traveling yarn 20 is delivered to the cheese. Additionally, each individual winding apparatus 2 in this case is also provided with one yarn breakage correcting device 21 and one suction nozzle 22. The suction nozzle 22 particularly performs the task of retrieving a broken yarn 20' that has run up onto the cheese 16, so that it can be grasped and advanced to the yarn breakage correcting device 21.

The multiple-part machine frame of the cheese winding machine 1 has a rail 23 for travel of a non-illustrated bobbin changer carriage, which is capable of lifting a completely wound cheese, for instance a cheese 24, out of the bobbin frame 18 and placing it on a conveyor belt 25.

Each winding apparatus 2 includes side walls 26, 27 and a machine housing 28.

The machine housing 28 includes the usual electrical and mechanical actuating an control devices that make winding operation possible, which among others include a microprocessor 29. No further description of these devices will be provided herein, because they are conventional. For instance, a drive motor present in the machine housing 28 drives the winding roller 19 in the direction of an arrow 30 during winding. The cheese 16 rests on the winding roller 19 due to the weight of the bobbin frame 18 and its own weight, and it is driven by friction through contact with the winding roller 19. The cheese 16 is fastened in such a way that it can move easily between rotatable bobbin plates in the forked bobbin frame 18. The outside of such a bobbin plate 31 can be seen in FIGS. 1 and 2. The pivot shaft 17 of the bobbin frame 18 is connected to the machine housing 28. The machine housing also has an eyelet-like yarn guide device 10, a housing 32 of the yarn breakage correcting device 21, a yarn cleaner 33, and a paraffin-applying device 34, having a paraffin roller 35 which rests on the running yarn 20.

The yarn delivery device 9, which is a mandrel for mounting a tube 36 of a spinning cop 37 that can be pivoted by a small angle $\alpha$, is connected to a machine frame part 8. In order to be refilled, the mandrel 9 is pivoted out of a payout position shown about the angle $\alpha$ in the direction of a cop magazine 39, which holds one or more spinning cops 40 in reserve. The cop magazine 39 thereupon automatically releases one of the cops held in reserve, which then slides along a non-illustrated guide path, onto the mandrel 9.

In this exemplary embodiment, the winding roller 19 is operated as a traversing yarn guide in order to produce the cross-wound layers of the cheese 16. The winding roller 19 is provided in a known manner with a reversing screw thread groove 41, which guides the traveling yarn 20.

The pivot shaft 17 of the bobbin frame 18, the yarn travel at the winding roller 19 in the direction of the cheese 16, and an inlet mouth 42 of the suction nozzle 22 are disposed on the same side of an imaginary plane 43, in which an axis of rotation 44 of the winding roller 19 and the center of gravity of the cheese 16 are located. The other side of the imaginary plane 43 is oriented toward a free space or area 45 extending along the cheese winding machine 1. The area 45 is a service walkway which is used in this case for servicing the machine, inspecting it, and equipping it with new cops. A second machine can be set up parallel to the first machine on the other side of the service walkway.

The suction nozzle 22 is in the form of a curved suction tube, having the inlet mouth 42 that widens out to the bobbin width. An oblong slit 46 which is shown in phantom, serves to guide the aspirating yarn 20', ends freely at the inlet mouth 42 and faces toward the yarn guide devices 11–14.

The suction nozzle 2 extends from above the winding roller 19 to the vicinity of the housing 32 of the yarn breakage correcting device 21. The suction nozzle 22 is supported on the machine housing 28 in such a way that it is pivotable by a small angle about a pivot shaft 47, and it ends in the machine housing 28 at a non-illustrated vacuum supply apparatus. The afore-mentioned oblong slit 46 extends as far downward as the phantom line indicates.

The movably disposed suction nozzle 22 has a control device identified generally by reference numeral 48, which keeps the inlet mouth 42 at a predetermined distance from the growing cheese 16. The control device is a control mechanism that steps up or carries over and transmits the motion of the bobbin frame 18 to the suction nozzle 22. The control mechanism is a multiple-link transmission that connects the bobbin frame 18 to the suction nozzle 22 and includes a lever 49, a bell crank 50, a control rod 51 and link points 52, 53, 54 and 55. The lever 49 is located at the rear end of the bobbin frame 18. The bell crank 50 is pivotably supported about the link point 54 on the machine housing 28. The link point 55 pivotably and also somewhat resiliently connects the bell crank 50 to the suction nozzle 22. The other end of the bell crank 50 is connected through the link point 53 and the control rod 51 to the link point 52 on the end of the lever 49.

Due to the increase in size of the cheese 16, the bobbin frame 18 pivots upward counterclockwise about the pivot shaft 17. As a result, the bell crank 50 is also caused to pivot counterclockwise about the link point 54. The bell crank 50 carries the suction nozzle 22 with it, which is thereby compelled to pivot about the pivot shaft 47, although about a substantially smaller pivot angle than the pivot angle of the bobbin frame. In this process, the inlet mouth 42 of the suction nozzle 22 moves a predetermined extent away from the cheese 16 which has a surface that is approaching it, so that the distance between the inlet mouth 42 and the surface of the bobbin always remains approximately the same.

If winding operation is unimpeded, the yarn 20 is paid out from the spinning cop 37 at a payout speed of approximately 1000 m per minute. The yarn passes through the yarn eyelet 10, an opened, controllable stopping brake 56 (of which only one of two brake disks is visible in FIGS. 1 and 2), then through yarn guide devices 11 and 12 of the yarn cleaner 33, yarn guide devices 13 and 14 of the paraffin-applicator device 34, and the reversing screw thread groove 41 of the bobbin winder 19, which is rotating in the direction of the arrow 30. From there, the yarn is laid in cross-wound layers on the rotating cheese 16. As soon as a yarn flaw or yarn breakage occurs, the yarn cleaner 33 issues a cutting signal to its own yarn cutter and also sends a signal to the microprocessor 29, which thereupon spontaneously closes the stopping brake 56 according to a program, so that it firmly holds the lower yarn. During this time, the upper yarn runs up onto the cheese 16. According to a program, the microprocessor 29 then causes the winding roller 19 to stop and then to move backward at slow speed. The suction nozzle 22 is then acted upon by a vacuum, causing the end of the upper yarn, which has traveled onto the cheese 16, to be aspirated first into the yarn nozzle 22 and then back into the suction device of the machine housing 28. However, due to the suction, the re-aspirated yarn 20' then emerges in crescent-shaped form from the oblong slit 46, as FIG. 1 shows, for instance. The microprocessor, for instance according to a program and after a predetermined period of time has elapsed, then activates a yarn gripper 57 having a holder rod 58 which is supported pivotably on the machine housing 28 about a pivot shaft 59.

The yarn gripper 57 then grips the yarn 20' and takes it along in the direction of a circular arc 60, by pivoting the holder rod 58 clockwise about the pivot shaft 59, causing the yarn to be returned into the forked yarn guide devices 11–14 and also into the yarn breakage correcting device 21. The yarn breakage correcting device 21 is a conventional yarn splicer, with a splicing channel that is open at the front and receives the yarn 20'.

The lower yarn coming from the spinning cop 37 is firmly clamped in the stopping brake 56 and held fast. It is then engaged by a suction tube 61 underneath the stopping brake 56, held fast, and likewise advanced to the yarn breakage correcting device 21, which then joins the two yarn ends together. For this purpose, the suction tube 61 is pivotably supported on the machine housing 28 about a pivot shaft 62 and in the machine housing 28 it is connected to the same suction apparatus as the suction nozzle 22. Through the use of a non-illustrated pivot mechanism controlled by the microprocessor 29, the suction tube 61 is pivoted out of its position of repose shown in FIG. 1, along a circular arc 63 until it is underneath the stopping brake 56, where it then picks up the lower yarn. The microprocessor then causes the opening of the stopping brake 56 according to its program, whereupon the suction tube 61 is then pivoted back counter-clockwise according to a program along with the lower yarn firmly held by it, until the yarn is given up to the yarn breakage correcting device 21. The holder rod 58 and the suction tube 61 are pivoted back to their positions of repose shown in FIG. 1, no later than whenever the upper and lower yarns are received by the yarn breakage correcting device 21 and the yarn connection is re-established, in the course of which their pivoting motions are adapted to one another in such a way that the parts do not hinder one another.

Once the yarn connection has been finished, the microprocessor 29 causes the restarting of the winding roller 19, whereupon normal winding operation resumes.

FIG. 2 shows the largest possible winding state of the cheese 16. The suction nozzle 22 has been pivoted back counter-clockwise by a small angle. As a result, its inlet mouth 42 has moved away from the surface of the bobbin approaching it.

I claim:

1. A machine for producing cross-wound bobbins or cheeses, comprising winding apparatuses each having a yarn delivery device, yarn guide devices disposed downstream of said yarn delivery device as seen in a yarn travel direction, a yarn take-up device disposed downstream of said yarn guide devices, said yarn take-up device having a bobbin frame for carrying a cheese with a center of gravity, said bobbin frame being pivotable about a pivot shaft, a winding roller for engaging the cheese and rotating about an axis of rotation for guiding the yarn around said winding roller from a given path of the yarn traveling toward the cheese, and at least one yarn breakage correcting device, and a suction nozzle with an inlet mouth for retrieving a broken yarn having run up onto the cheese, the center of gravity of the cheese and said axis of rotation of said winding roller defining an imaginary plane with one side on which said pivot shaft of said bobbin frame, said given path of the yarn at said winding roller, and said inlet mouth are all disposed and another side facing a free space extending along the cheese winding machine.

2. The cheese winding machine according to claim 1, wherein said free space is a servicing space.

3. The cheese winding machine according to claim 1, wherein said free space is an equipping space.

4. The cheese winding machine according to claim 1, wherein said free space is an inspection space.

5. The cheese winding machine according to claim 1, including a control device for moving said suction nozzle and maintaining said inlet mouth at a predetermined distance from the cheese as the cheese grows in size.

6. The cheese winding machine according to claim 5, wherein said control device is a control mechanism for carrying over and transmitting motion of said bobbin frame to said suction nozzle.

7. The cheese winding machine according to claim 6, wherein said control mechanism is a multiple-link transmission connecting said bobbin frame to said suction nozzle.

8. The cheese winding machine according to claim 1, wherein said suction nozzle is a suction tube being curved toward said given path of the yarn and having a concave side, said inlet mouth is widened to a width of the cheese, and said suction nozzle has an oblong slit formed in said concave side, said oblong slit ending freely at said inlet mouth and facing toward said yarn guide devices for guiding the broken yarn aspirated into said inlet mouth.

9. The cheese winding machine according to claim 1, wherein said suction nozzle is a suction tube being curved toward said given path of the yarn and having a concave side, said inlet mouth is widened to a width of the cheese, and said suction nozzle has an oblong slit formed in said concave side, said oblong slit ending freely at said inlet mouth and facing toward said yarn breakage correcting device for guiding the broken yarn aspirated into said inlet mouth.

10. The cheese winding machine according to claim 1, wherein said suction nozzle is a suction tube being curved toward said given path of the yarn and having a concave side, said inlet mouth is widened to a width of the cheese, and said suction nozzle has an oblong slit formed in said concave side, said oblong slit ending freely at said inlet mouth and facing toward said yarn guide devices and said yarn breakage correcting device for guiding the broken yarn aspirated into said inlet mouth.

11. A machine for producing cross-wound bobbins or cheeses, comprising winding apparatuses each having a yarn take-up device with a bobbin frame for carrying a cheese with a center of gravity, said bobbin frame being pivotable about a pivot shaft, a winding roller for engaging the cheese and rotating about an axis of rotation for guiding the yarn around said winding roller from a given path of the yarn traveling toward the cheese, at least one yarn breakage correcting device, and a suction nozzle with an inlet mouth for retrieving a broken yarn having run up onto the cheese, the center of gravity of the cheese and said axis of rotation of said winding roller defining an imaginary plane with one side on which said pivot shaft of said bobbin frame, said given path of the yarn at said winding roller, and said inlet mouth are all disposed and another side facing a free access space for personnel extending along the cheese winding machine.

* * * * *